US007741554B2

(12) United States Patent
Sasaki et al.

(10) Patent No.: US 7,741,554 B2
(45) Date of Patent: Jun. 22, 2010

(54) APPARATUS AND METHOD FOR AUTOMATICALLY CREATING MUSIC PIECE DATA

(75) Inventors: Michihiko Sasaki, Hamamatsu (JP); Kenichiro Yamaguchi, Shibuya-ku (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 12/056,947

(22) Filed: Mar. 27, 2008

(65) Prior Publication Data

US 2008/0257133 A1 Oct. 23, 2008

(30) Foreign Application Priority Data

Mar. 27, 2007 (JP) ..... 2007-081857

(51) Int. Cl.
*G10H 1/00* (2006.01)

(52) U.S. Cl. ..... 84/609; 84/611; 84/612; 84/649; 84/652

(58) Field of Classification Search ..... 84/609, 84/611, 612, 649, 652
See application file for complete search history.

(56) References Cited

U.S. PATENT DOCUMENTS

| | | | | |
|---|---|---|---|---|
| 5,679,913 | A * | 10/1997 | Bruti et al. | 84/609 |
| 5,736,663 | A * | 4/1998 | Aoki et al. | 84/609 |
| 6,143,971 | A * | 11/2000 | Aoki et al. | 84/609 |
| 6,162,982 | A * | 12/2000 | Aoki | 84/611 |
| 6,252,152 | B1 * | 6/2001 | Aoki et al. | 84/609 |
| 6,384,310 | B2 * | 5/2002 | Aoki et al. | 84/609 |
| 6,417,437 | B2 * | 7/2002 | Aoki | 84/611 |
| 6,576,828 | B2 * | 6/2003 | Aoki et al. | 84/635 |
| 6,746,247 | B2 * | 6/2004 | Barton | 434/247 |
| 7,311,658 | B2 * | 12/2007 | Elliott | 600/28 |
| 2003/0159567 | A1 * | 8/2003 | Subotnick | 84/626 |
| 2004/0077934 | A1 * | 4/2004 | Massad | 600/300 |
| 2005/0163481 | A1 | 7/2005 | Hirai | |
| 2005/0215846 | A1 * | 9/2005 | Elliott | 600/26 |
| 2006/0102171 | A1 * | 5/2006 | Gavish | 128/95.1 |
| 2006/0111621 | A1 * | 5/2006 | Coppi et al. | 600/300 |

(Continued)

FOREIGN PATENT DOCUMENTS

JP 10-63265 A 3/1998

(Continued)

*Primary Examiner*—David S. Warren
(74) *Attorney, Agent, or Firm*—Rossi, Kimms & McDowell LLP

(57) ABSTRACT

A plurality of template data files are provided, each designating a structure and conditions of a music piece, and having a plurality of tracks, each track being assigned to a particular instrument group and defining a time progression structure of music to be performed by the assigned instrument group by setting performance sections at time positions to be performed by the assigned instrument group along the time progression of music. A plurality of component data files are provided, each representing a length of musical phrase that constitutes a predetermined tone progression pattern of a predetermined tone color for a performance by a particular instrument group. When conditions such as a tempo for a music piece to be created are given, a template data file that satisfies the given conditions is selected. Then, component data files are picked up according to the conditions designated by the selected template data file and the musical phrases are placed on the tracks in the template data file. Thus, data files of many and versatile music pieces are automatically created, satisfying the given conditions.

8 Claims, 12 Drawing Sheets

*Processing for Creating Music Piece*
*(Part 2)*

U.S. PATENT DOCUMENTS

| | | | | |
|---|---|---|---|---|
| 2006/0185502 | A1* | 8/2006 | Nishitani et al. | 84/615 |
| 2007/0044641 | A1* | 3/2007 | McKinney et al. | 84/612 |
| 2007/0071256 | A1* | 3/2007 | Ito | 381/118 |
| 2007/0079691 | A1* | 4/2007 | Turner | 84/612 |
| 2007/0270667 | A1* | 11/2007 | Coppi et al. | 600/300 |
| 2008/0257133 | A1* | 10/2008 | Sasaki et al. | 84/604 |

FOREIGN PATENT DOCUMENTS

| | | | |
|---|---|---|---|
| JP | 2000-99015 | A | 4/2000 |
| JP | 2003-85888 | A | 3/2003 |
| JP | 2004-113552 | A | 4/2004 |
| JP | 2005-190640 | A | 7/2005 |

* cited by examiner

*Fig. 1 Template Data and Component Data*

*Fig. 2* *Structure of Music to Be Created*

Fig. 3a Contents of Template List

| Template ID | Genre | Slowest Tempo | Fastest Tempo |
|---|---|---|---|
| Template #1 | Genre #1 | 100 | 150 |
| Template #2 | Genre #3 | 160 | 200 |
| Template #3 | Genre #1 | 50 | 80 |
| Template #4 | Genre #4 | 130 | 180 |
| Template #5 | Genre #2 | 80 | 120 |
| ... | ... | ... | ... |

Fig. 3b Contents of Template Data File

Music Progression (Per Measure)

| Track | Inst. Gr. | 1 | 2 | 3 | 4 | 5 | 6 | 7 | 8 |
|---|---|---|---|---|---|---|---|---|---|
| kik | kik | 11 | 1 | 11 | 1 | 11 | 1 | 11 | 1 |
| sd | sd | 0 | 0 | 0 | 0 | 11 | 1 | 11 | 1 |
| hh | hh | 0 | 0 | 0 | 0 | 0 | 0 | 0 | 0 |
| tom | tom | 0 | 0 | 0 | 0 | 0 | 0 | 0 | 11 |
| tr1 | bass | 0 | 0 | 0 | 0 | 0 | 0 | 0 | 0 |
| tr2 | sec | 0 | 0 | 0 | 0 | 0 | 0 | 0 | 0 |
| tr3 | | 0 | 0 | 0 | 0 | 0 | 0 | 0 | 0 |
| tr4 | | 0 | 0 | 0 | 0 | 0 | 0 | 0 | 0 |
| tr5 | | 0 | 0 | 0 | 0 | 0 | 0 | 0 | 0 |
| tr6 | pad | 0 | 0 | 0 | 0 | 11 | 1 | 1 | 1 |
| tr7 | | 0 | 0 | 0 | 0 | 0 | 0 | 0 | 0 |
| tr8 | | 0 | 0 | 0 | 0 | 0 | 0 | 0 | 0 |
| tr9 | | 0 | 0 | 0 | 0 | 0 | 0 | 0 | 0 |
| tr10 | | 0 | 0 | 0 | 0 | 0 | 0 | 0 | 0 |
| tr11 | piano | 1 | 1 | 0 | 0 | 1 | 1 | 0 | 0 |
| tr12 | | 0 | 0 | 0 | 0 | 0 | 0 | 0 | 0 |
| tr13 | | 0 | 0 | 0 | 0 | 0 | 0 | 0 | 0 |
| tr14 | scrach | 0 | 0 | 11 | 1 | 0 | 0 | 11 | 1 |
| tr15 | | 0 | 0 | 0 | 0 | 0 | 0 | 0 | 0 |
| tr16 | | 0 | 0 | 0 | 0 | 0 | 0 | 0 | 0 |

*Fig. 4a* *Contents of Component List*

| Component # | Inst. Gr. | Genre #1 | Genre #2 | Genre #3 | Number of Measures | Slowest Tempo | Fastest Tempo | Priority Grade |
|---|---|---|---|---|---|---|---|---|
| Component #1 | kik | 1 | | | 1 | 120 | 160 | 10 |
| Component #2 | sd | | 1 | | 2 | 100 | 150 | 12 |
| Component #3 | hh | 1 | 1 | | 1 | 160 | 200 | 19 |
| Component #4 | fil | 1 | | | 1 | 130 | 180 | 10 |
| Component #5 | bass | | | 1 | 1 | 50 | 80 | 15 |
| ... | ... | ... | ... | ... | ... | ... | ... | ... |

*Fig. 4b* *Examples of Instrument Groups*

| Instrument Group ID | Example of Instrument | Family |
|---|---|---|
| kik | Kick Drum | Drum Family |
| sd | Snare Drum | Drum Family |
| hh | High-Hat Cymbals | Drum Family |
| tom | Tom-Tom | Drum Family |
| percsmall | Purcussion Small | Drum Family |
| shaker | Shaker | Drum Family |
| tamb | Tambour | Drum Family |
| minihh | Mini-High-Hat | Drum Family |
| minisd | Mini-Snare-Drum | Drum Family |
| clp | Clap | Drum Family |
| cvm | Cymbals | Drum Family |
| ride | Riding | Drum Family |
| rim | Rim Beating | Drum Family |
| fill | Fill | Drum Family |
| conga | Conga Drum | Drum Family |
| bell | Bells | Drum Family |
| click | Click | Drum Family |
| bass | Bass | Other Family |
| seq | Sequencer | Other Family |
| pad | Electronic Drum | Other Family |
| guiter | Guitar | Other Family |
| chord | Chord | Other Family |
| lead | Lead | Other Family |
| scrach | Scratching | Other Family |
| organ | Organ | Other Family |
| piano | Piano | Other Family |

Fig.5a *Processing for Creating Music Piece (Part 1)*

Fig.5b *Processing for Creating Music Piece (Part 2)*

Fig.6a *Processing for Selecting Component Data File with Selection Probability Determined by Priority Grade (Part 1)*

Fig.6b *Processing for Selecting Component Data File with Selection Probability Determined by Priority Grade (Part 2)*

*Fig. 7*

| Component # | Selection Candidate | Priority Grade Point | Number of Loop | Selection Probability | Selection Probability Check Value |
|---|---|---|---|---|---|
| | 24 | 10 | 1 | 20 | 20 |
| | 18 | 9 | 2 | 18 | 38 |
| | 35 | 10 | 3 | 20 | 58 |
| | 79 | 12 | 4 | 24 | 82 |
| | 81 | 9 | 5 | 18 | 100 |
| | - | Sum = 50 (Selection Probability Denominator) | | | |
| | - | | | | |
| | - | | | | |
| | - | | | | |
| | - | | | | |
| | - | | | | |
| | - | | | | |

Fig.8 *Functional Configuration of Controlling Music Piece Creation*
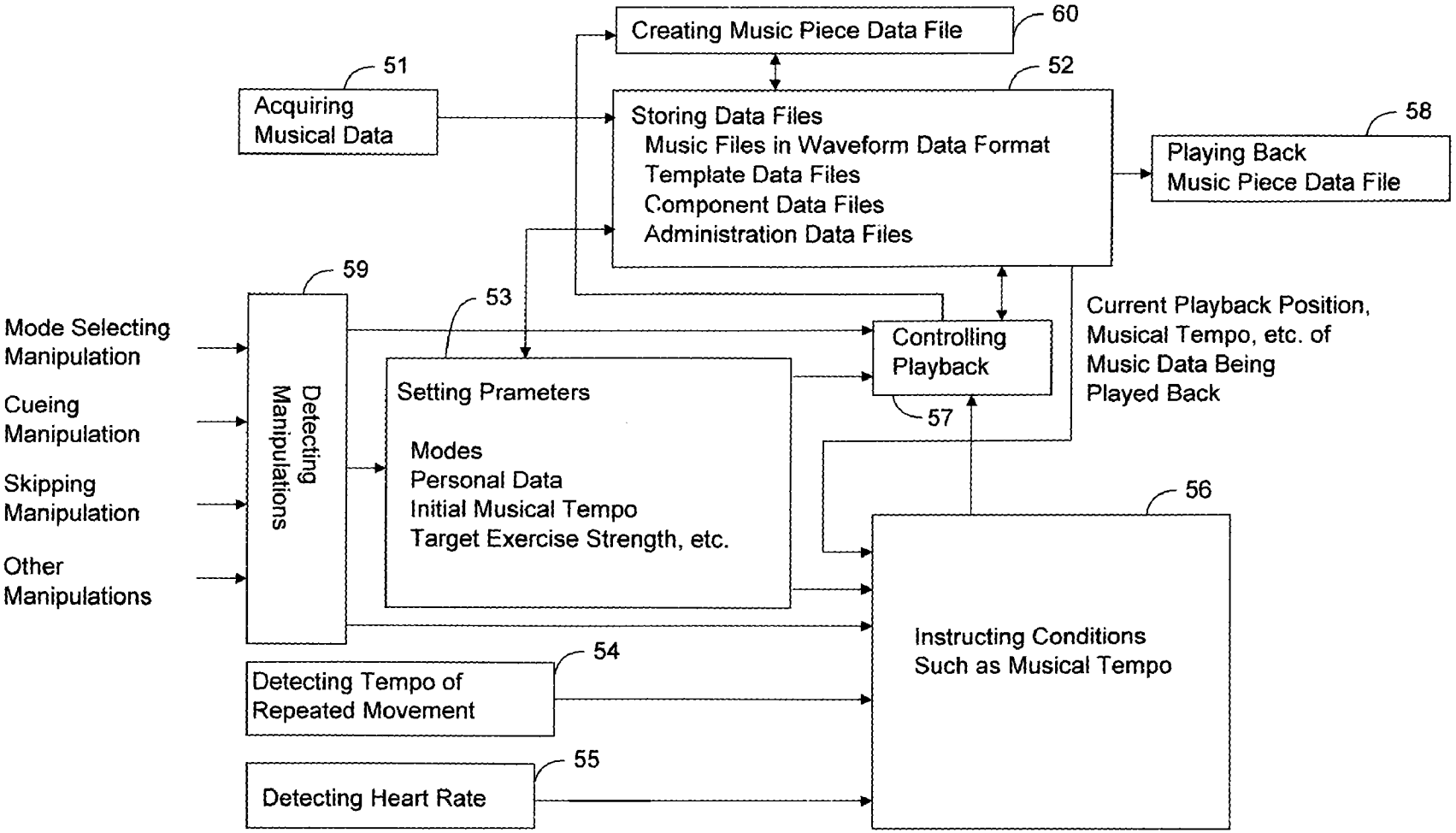

Fig.9 *Hardware Configuration for Creating Music Piece*
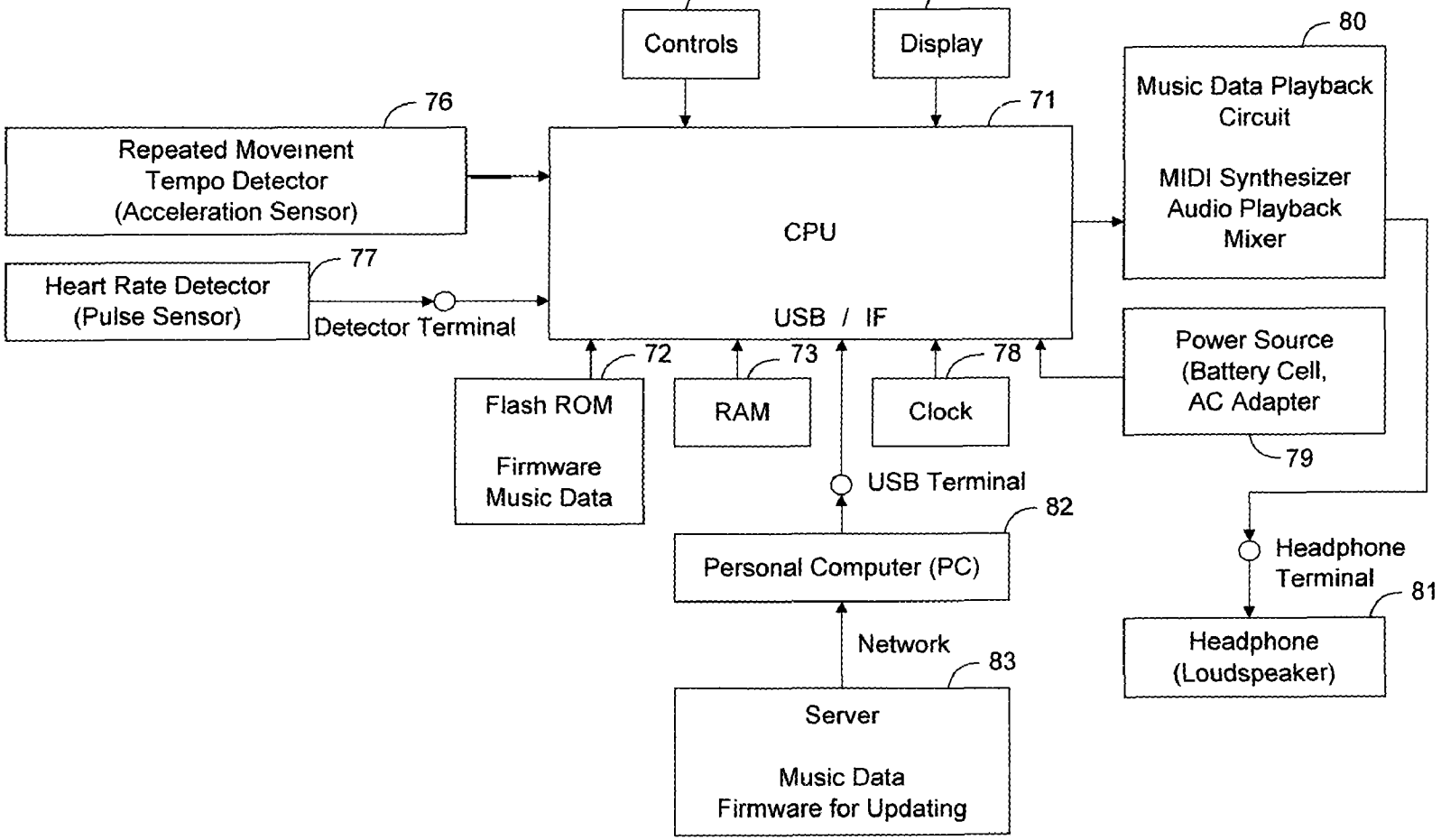

APPARATUS AND METHOD FOR AUTOMATICALLY CREATING MUSIC PIECE DATA

TECHNICAL FIELD

The present invention relates to an apparatus and a method for automatically creating music piece data files, and more particularly to such an apparatus and a method for automatically creating data files of music pieces which satisfy given conditions such as a tempo of the music, and also to a music playback controlling apparatus to be used in combination with the above-mentioned apparatus for automatically creating music piece data files which controlling apparatus stores music piece data files in a data format of tone waveform and selects a music piece data file that satisfies an instructed tempo from among the music piece data files in the data format of tone waveform, if any, but selects a music piece data file that satisfies the instructed tempo from among the music piece data file created by the apparatus for automatically creating music piece data files. The music playback controlling apparatus can be advantageously utilized for a portable music player for playing back music to which the user can do aerobics such as walking, jogging and dancing.

BACKGROUND INFORMATION

Conventionally known in the art is a music playback apparatus to be used for listening to music while walking, which apparatus detects the walking rate (the tempo of the repetitive movement) of the user and alters the tempo of the music being played back to match the tempo of the repetitive movement so that the integrality of the user's movement and the music progression will be enhanced. An example of such a music playback apparatus is disclosed in unexamined Japanese patent publication No. 2003-85888.

Such an apparatus, however, synchronizes the music with the user's movement by simply altering the tempo of the same predetermined music piece. And accordingly, the music piece played back in a tempo which is different from its original tempo may sound unnatural and queer to the user as compared with its intended performance. Furthermore, mere change in tempo will not change the mood of the music, the user may get bored with the music and may lose the will to continue the exercise. In addition, in the case of a music piece recorded in a data format of tone waveform, the change in playback tempo will cause changes in tone pitch unless some special signal processing should be applied, and the user will feel a sense of strangeness.

Further known in the art is an automatic music playing apparatus which detects the heart rate of the user, calculates a exercise strength percentage from the detected heart rate, specifies tempo coefficients P=1.0 through 0.7 according to the calculated exercise strength percentage of from below 70% to above 100%, selects an automatic music playing data files (in the data format of musical notation) having the original tempo equal to the calculated tempo from among the stored music playing data files respectively prepared in various original tempos to correspond to various tempo coefficients as will be calculated. An example of such an automatic music playing apparatus is disclosed in unexamined Japanese patent publication No. H10-63264. The apparatus plays back a music piece having the original tempo which meets the exercise strength of the user. However, music playing data files only in the data format of musical notation (automatic performance data format) may present music having less rich musicality.

Still further known in the art is an exercise aiding apparatus which stores music piece data files of various tempos in the MIDI format (performance data format), calculates a walking rate to be informed of to the exerciser based on the characteristic information about the walking course and the physical conditions of the exerciser, presents to the exerciser a list of music numbers having a tempo which approximately coincides with the calculated walking rate from among the stored music piece data files, lets the exerciser select a desired music piece data file, modifies the tempo of the selected music piece data file to coincide with the calculated walking rate, and produces musical sounds of the modified musical data. An example of such an exercise aiding apparatus is disclosed in unexamined Japanese patent publication No. 2004-113552.

As all of such known apparatuses, however, uses music piece data files stored beforehand in the apparatus, increase in the total number of stored music data files would increase the capacity of the storage, while decrease in the total number may cause a situation that there is no music data file that satisfies the necessary conditions such as a tempo or that there are only a few such music piece data files so that the same music piece or pieces would be played back frequently and the user may get bored with the music. On the other hand, if the original tempo of a music piece should be changed to obtain a music piece data file of the required tempo, the played back music piece would sound unnatural.

Still further known in the art is a portable music player such as a MP3 (MPEG-1 Audio Layer-III) player which stores a multiplicity of music pieces and plays back music pieces in succession (one after another) automatically. However, such a player will not always play back music pieces to the user's liking. The played music piece may meet the user's taste some time, but the next (succeeding) number in the sequence may be of a different tempo or a different tonality.

Also known in the art is a music reproducing apparatus which evaluates the user's likes and dislikes about music pieces and adequately selects music pieces reflecting the evaluated liking, and automatically plays back the selected music pieces in succession. An example of such a music playback apparatus is disclosed in unexamined Japanese patent publication No. 2005-190640.

With the apparatus mentioned above, when the user pushes the skip button while a music piece is being played back, the apparatus quits the playback operation and evaluates the user's liking in value about the quit music piece reflecting the skip button operation, and registers the evaluation values in association with the music pieces to make a database of the user's liking about the music pieces. The publication discloses some examples of evaluation. For example, when the user manipulates the button to skip back (to cue) to the start of the music piece which was being played back heretofore, the heretofore registered evaluation value is increased by "+3." It also discloses an "evaluation plus button," an "evaluation minus button" and a "re-evaluation button." It also discloses an idea of randomly selecting music pieces of the user's higher liking from among the stored music pieces based on the database about the user's liking information, but does not describe a specific embodiment therefor.

Generally speaking, in order to comply with various demands and likings about music pieces to be played back, the apparatus should store so many music piece data files, which will inevitably increase the capacity of the storage device. Further, this will need the work of storing so many music piece data files in the storage device beforehand, which work will be troublesome.

A way to dispense with such troublesome preparation may be to automatically compose music pieces instead of storing so many music pieces. However, conventionally known apparatuses and methods for composing music were to analyze and extract musical characteristic features of the existing music pieces and compose variety of music pieces. Such a trend can be seen in unexamined Japanese patent publication No. 2000-99015. So, there can hardly be found an apparatus or a method for automatically compose a multiplicity of music pieces which satisfy limited conditions such as a tempo of the music for creating music pieces.

SUMMARY OF THE INVENTION

In view of the foregoing circumstances, therefore, it is a primary object of the present invention to provide an apparatus and a method for automatically creating data files of music pieces which satisfy given conditions such as a tempo of the music, and also a music playback controlling apparatus to be used in combination with such an apparatus for automatically creating music piece data files.

According to the present invention, the object is accomplished by providing an apparatus for automatically creating music piece data comprising: a memory device for storing a plurality of component data files, each representing a length of musical phrase that constitutes a predetermined tone progression pattern of a predetermined tone color for a performance by a particular instrument group, and a plurality of template data files, each designating a structure and conditions of a music piece and including a plurality of tracks, each track being assigned to a particular instrument group and defining a time progression structure of music to be performed by the assigned instrument group by setting performance sections at time positions to be performed by the assigned instrument group along the time progression of music; a condition instructing device for instructing conditions for creating a music piece data file; a template selecting device for selecting a template data file that satisfies the condition instructed by the condition instructing device; a component selecting device for selecting, for each of the plurality of tracks included in the template data file that is selected by the template selecting device, a component data file that satisfies at least the condition instructed by the condition instructing device and the condition designated by the template data file that is selected by the template selecting device, from among the plurality of component data files which are for the instrument group assigned to the track; and a music piece composing device for composing a music piece data file by disposing the musical phrases of the component data files selected by the component selecting device at the performance sections set on the tracks in the template data file that is selected by the template selecting device. As a music piece data file is created by the combination of a plurality of tracks, each defining a music progression pattern of performance sections by an assigned instrument group, and a plurality of components, each representing a musical phrase defining a performance pattern by the assigned instrument group to be disposed at a corresponding performance section on the track, according to a given condition for creating a music piece, data files of many and versatile music pieces are automatically created, satisfying the given conditions. The condition instructed by the condition instructing device may be any one or more of a musical tempo, a musical genre, a physical condition (such as a movement tempo and a heart rate detected by a sensor), and also may be any environmental conditions of the place where the user is listening to the music (such as the time, the place by latitude and longitude, the altitude, the weather, the temperature, the humidity, the brightness, the wind force, etc.) as can be obtained by a clock, the global positioning system (GPS), and other communication devices. Then the apparatus can automatically create, in real time, a music piece which fit the environment where the user is listening to the music. These condition data will only have to be processed in association with the data of the musical tempo and the musical genre designated in the template data files and the component data files. Specific keywords (e.g. morning, noon, afternoon, evening and night for the time) may be used to designate the physical conditions or the environmental conditions in the template data files and the component data files.

In an aspect of the present invention, the template data file includes designations of a musical tempo and a musical genre of music to be created; the component data file includes designations of a musical tempo and a musical genre of music for which the musical phrase is to be used; the condition instructing device instructs at least a musical tempo of music to be created; the template selecting device selects a template data file that satisfies at least the musical tempo instructed by the condition instructing device; the component selecting device selects, for each of the plurality of tracks included in the template data file selected by the template selecting device, a component data file that includes a designation of a musical tempo of substantially the same value as the tempo value instructed by the condition instructing device and a designation of a musical genre included in the template data file selected by the template selecting device, from among the plurality of component data files which are for the instrument group designated for the track; and the music piece composing device composes a music piece data file by designating the musical tempo that is instructed by the condition instructing device. Thus, where a tempo is instructed as the condition for creating a music piece, a music piece will be composed by using a template data file and component data files that satisfy the instructed tempo. The created music piece data file is in the data format of musical notation (and not of tone waveform) whose tempo is perfectly equal to the instructed tempo without any need of compressing or expanding time axis which may be necessary in the case of a music piece data file in the data format of tone waveform. The designation of the tempo in the template data file and the component data files may be set by a particular tempo value or may be set by a range of the tempo value. In the case of the former setting, an instructed tempo is to be subject to judgment whether the instructed tempo is within a predetermined tolerance from the set tempo. In the case of the latter setting, an instructed tempo is to be subject to judgment whether the instructed tempo is within the set range.

In another aspect of the present invention, the component data file has a priority grade for being selected; and the component selecting device selects, for each of the plurality of tracks included in the template data file selected by the template selecting device, candidate component data files, each of which satisfies at least one of the condition instructed by the condition instructing device and the condition designated by the template data file selected by the template selecting device, from among the plurality of component data files which are for the instrument group designated for the track, and then selects a component data file from among the candidate component data files according to a selection probability that is calculated based on the priority grade of each candidate component data file. Thus, the priority grade of each component data file will be reflected in the selection probability of the component data file according to which a component data file is selected from among the candidate component data files which satisfy the conditions instructed by the condition instructing device.

In a further aspect of the present invention, the apparatus for automatically creating music piece data further comprises: a music piece playback device for playing back the music piece data file composed by the music piece composing device; a manipulation detecting device for detecting a manipulation by a user of the apparatus to alter the priority grade; and a priority altering device for altering the priority grade of at least one of the component data files comprised in the music piece data file which is being played back in response to the detected manipulation to alter the priority grade during the playback of the composed music piece data file by the music piece playback device. Thus, the priority grade of the music piece data file which is being played back can be easily altered according to the manipulation by the user so that the apparatus can learn the liking of the user about the component data files, which will cause the selection of the component data files according to the selection probabilities that reflect the user's liking and will create a music piece data file accordingly. As the priority grades are used to determine selection probabilities, the selected component data files are not always those having higher priority grades, but the component data files having lower priority grades may possibly be selected according to the selection probabilities.

According to the present invention, the object is further accomplished by providing a music playback controlling apparatus to be used in combination with the apparatus for automatically creating music piece data as mentioned above wherein the composed music piece data file is in a data format of musical notation, the controlling apparatus comprising: a music waveform data storing device for storing a plurality of music data files representing music pieces in a data format of tone waveform, each of the stored music data files having a designated musical tempo at which the stored music piece is to be played back; a musical tempo instructing device for instructing a musical tempo of a music piece to be played back; a music piece selecting device for selecting, if any, a music piece data file in the data format of tone waveform having the designated musical tempo that is substantially equal to the musical tempo instructed by the musical tempo instructing device from among the music data files in the data format of tone waveform, and if not, causing the condition instructing device to instruct the musical tempo that is instructed by the musical tempo instructing device, thereby causing the music piece composing device to compose a music piece data file at the instructed musical tempo, and selecting the thus composed music piece data file; and a music piece playback device for playing back the music piece data file selected by the music piece selecting device. Thus, in the case where there is a music data file stored in the data format of tone waveform having a tempo value that is approximately equal to the instructed tempo value, a music piece having a good quality can be played back, and in the case where there is no music data file stored in the data format of tone waveform, a music piece data file in the data format of musical notation will be created and played back. A music piece having an intended tempo can be played back in a good quality most of the time.

According to the present invention, the object is still further accomplished by providing a method for automatically creating music piece data comprising: a step of storing a plurality of component data files, each representing a length of musical phrase that constitutes a predetermined tone progression pattern of a predetermined tone color for a performance by a particular instrument group, and a plurality of template data files, each designating a structure and conditions of a music piece by including a plurality of tracks, each track being assigned to a particular instrument group and defining a time progression structure of music to be performed by the assigned instrument group by setting performance sections at time positions to be performed by the assigned instrument group along the time progression of music; a step of instructing conditions for creating a music piece data file; a step of selecting a template data file that satisfies the conditions instructed by the step of instructing; a step of selecting, for each of the plurality of tracks included in the template data file that is selected by the step of selecting a template data file, a component data file that satisfies at least the condition instructed by the step of instructing and the conditions designated by the template data file that is selected by the step of selecting a template data file, from among the plurality of component data files which are for the instrument group assigned to the track; and a step of composing a music piece data file by disposing the musical phrases of the component data files as selected by the step of selecting a component data file, at the performance sections set on the tracks in the template data file that is selected by the step of selecting a template data file.

In the apparatus of the present invention, the structural element devices can be structured by means of hardware circuits or by a computer system performing the assigned functions in accordance with the associated programs. For example, the condition instructing device, the template selecting device, the component selecting device, the music composing device and the priority altering device can be practiced using hardware circuits or using a computer system operated with the programs to perform the respective functions. Further, for example, the music playback controlling apparatus (including the musical tempo instructing device and the music piece selecting device) to be used in combination with the automatic music piece data creating device can also be practiced using a computer system in association with the programs for performing the necessary functions.

The memory device and the music piece playback device may be formed integral within the music piece data creating device, or may be formed separate therefrom and connected thereto via a wired or wireless communication line. Further, the music piece data creating device, the music waveform data storing device and the music piece playback device may be formed integral with the music playback controlling device, or may be formed separate from the music playback controlling device and connected thereto via a wired or wireless communication line.

The invention and its various embodiments can now be better understood by turning to the following detailed description of the preferred embodiments which are presented as illustrated examples of the invention defined in the claims. It is expressly understood that the invention as is defined by the claims may be broader than the illustrated embodiments described bellow.

BRIEF DESCRIPTION OF THE DRAWINGS

For a better understanding of the present invention, and to show how the same may be practiced and will work, reference will now be made, by way of example, to the accompanying drawings, in which:

FIG. 7 is a chart showing a specific example of how the processing of FIGS. 6*a* and 6*b* is conducted;

FIG. 8 is a block diagram showing the functional configuration of controlling music piece creation in an embodiment of the present invention; and FIG. 9 is a block diagram showing the hardware configuration for creating a music piece data file in an embodiment of the present invention.

DETAILED DESCRIPTION OF EMBODIMENTS OF THE INVENTION

The present invention will now be described in detail with reference to the drawings showing preferred embodiments thereof. It should, however, be understood that the illustrated embodiments are merely examples for the purpose of understanding the invention, and should not be taken as limiting the scope of the invention.

Figure 1:
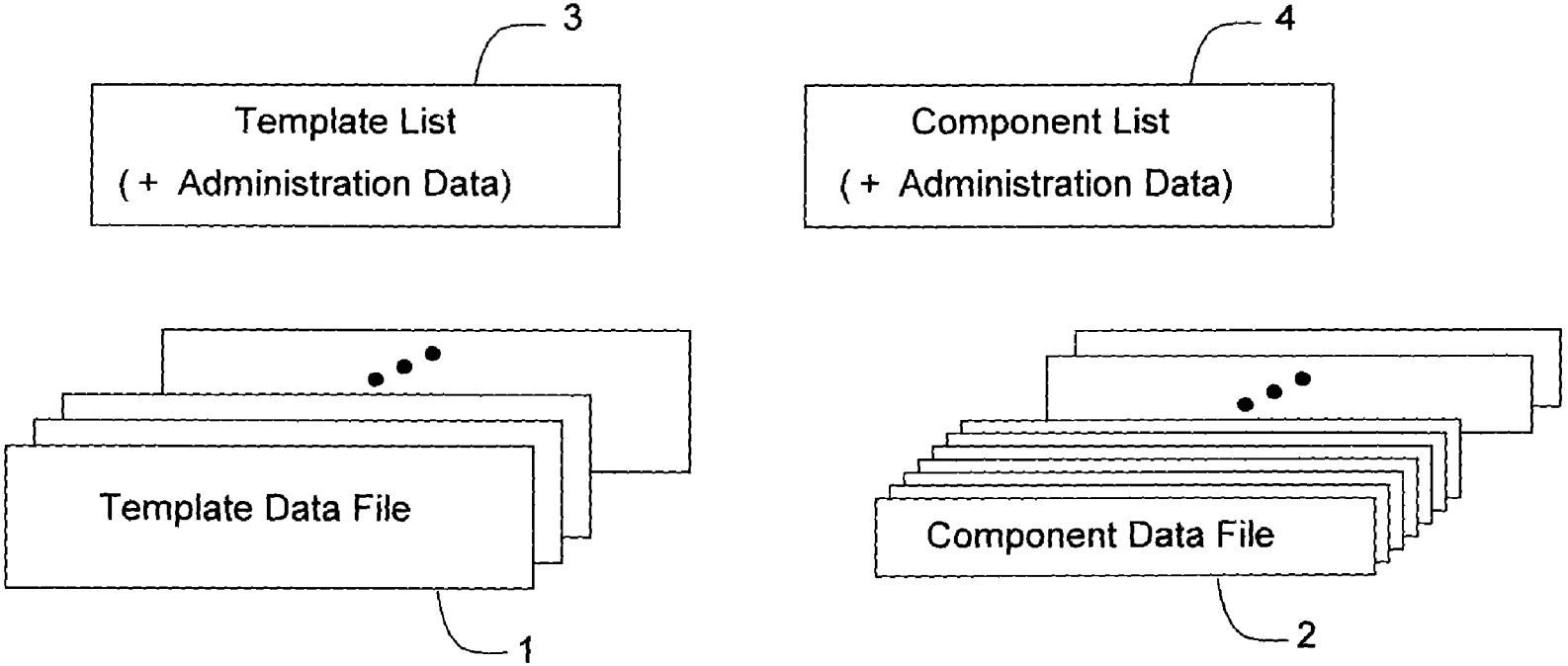
FIG. 1 is a chart showing template data files and component data files used in an embodiment of an apparatus for automatically creating music piece data file according to the present invention.

The present invention is an apparatus and a method for automatically creating a music piece data file which satisfies the instructed music piece data creating conditions using a template data file defining the structure of a music piece to be created and a plurality of component data files, each defining a musical phrase to be used for the template data file. FIG. 1 is a chart showing template data files and component data files used in an embodiment of an apparatus for automatically creating music piece data file according to the present invention.

A plurality of template data files 1, a plurality of component data files 2, a template list 3 which administers the template data files 1, and a component list 4 which administers the component data files 2 are stored in a memory device or storage device. The template list 3 is referred to for a template data file to be read out from the memory device, and the component list 4 is referred to for component data files to be read out from the memory device.

The template data file is a data file that describes a structure of and conditions for a music piece with a plurality of tracks, each assigned to an instrument group to perform the music piece and each defining a time progression structure of the music piece by disposing musical phrases at time positions along the music progression. In an embodiment of the present invention, the template data file includes a plurality of tracks, and each of the tracks is designated for an instrument group to play the music piece and has performance sections, each for performing a music phrase of a tone progression pattern given by a component data file of the designated instrument group. Musical conditions such as a musical genre and a musical tempo range are also set for each template data file.

The component data file is a data file that constitutes a performance data fragment in the data format of musical notation (e.g. MIDI format) representing a length (e.g. a few measures) of musical phrase to be played in a designated tone color (musical instrument) as identified by a program number. The data file is described with MIDI message data and event time data in pairs. An embodiment of the component data file is designated for one or more instrument groups and includes a length of performance data of a predetermined tone progression pattern (or performance pattern) in a predetermined tone color. The length is, for example, of one or two or four measures. The tone progression pattern is generally a complex pattern consisting of a pattern in the time direction and a pattern in the pitch direction. The time direction pattern makes a rhythm, while the pitch direction pattern makes a melody. The tone progression pattern constituting a melody is called a melody phrase (or simply "a phrase" usually). With respect to percussion instruments, the tone progression pattern generally consists of only a time direction pattern, i.e. a rhythm pattern. For each component data file, musical conditions such as a musical genre and a musical tempo range are also set.

Figure 2:
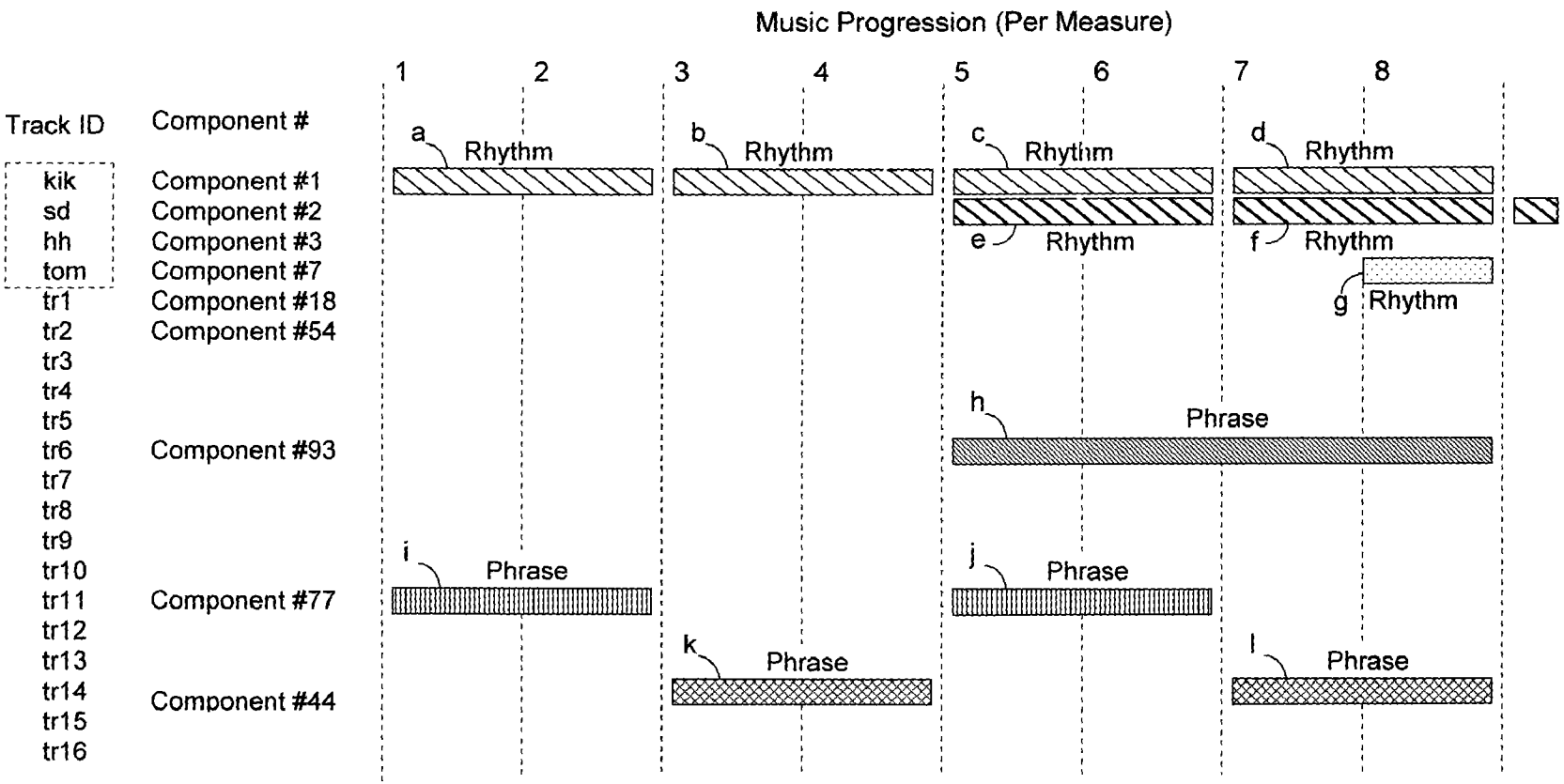
FIG. 2 is a chart showing the structure of a music data file to be created in an embodiment of the present invention, as depicted in a way similar to a piano roll.

To begin with, a description will be made about how to create a music piece data file using a template data file and component data files. FIG. 2 is a chart showing the structure of a music data file to be created in an embodiment of the present invention, as depicted in a way similar to a piano roll. The template data file carries the data contents to define this structure. In FIG. 2, a plurality of tracks are placed juxtaposed) in the vertical direction. Tracks tr1 through tr16 are processing channels for components of melody phrases having pitch-and-time patterns. Tracks for processing components of rhythm phrases having only time patterns for percussion instruments are prepared separately from the tracks tr1 through tr16. At least some of the tracks tr1 through tr16 are assigned for disposing (placing) component data files. In the embodiment of FIG. 2, the tracks "kik", "sd", "hh" and "tom" are assigned for the components #1, #2, #3 and #7, and the tracks tr1, tr2, tr6, tr11 and tr14 are assigned for the components #18, #54, # 93, #77 and #44, respectively. The other tracks are not assigned for any components.

In FIG. 2, the horizontal direction represents a time axis, and along the time axis are arrayed measure 1, measure 2, and so forth to form a music progression. A rectangular strip "a" shows a performance section on the track "kik" covering measure 1 and measure 2 which are filled (or occupied) with the rhythm phrase (rhythm pattern) represented by the component data file #1 (having a length of two measures). The rhythm phrase is simply denoted by "rhythm" in FIG. 2. Similarly, the rhythm phrase of the component data file #1 is placed also in performance sections "b", "c" and "d" repeatedly. Rectangular strips "e" and "f" show performance sections (each covering two measures) on the track "sd" covering measures 5-6 and measures 7-8, respectively, which are filled with the rhythm phrase represented by the component data file #2 (having a length of two measures). A rectangular strip "g" shows a performance section on the track "hh" covering only measure 8 which is filled with the rhythm phrase represented by the component data file #3 (having a length of one measure). A rectangular strip "h" shows a performance section on the track tr6 covering measures 5 through 8 which are filled with the melody phrase (melody pattern) represented by the component data file #93 (having a length of four measures). The melody phrase is simply denoted by "phrase" in FIG. 2. Rectangular strips "i" and "j" show performance sections on the track tr11 covering measures 1-2 and measures 5-6, respectively, which are filled with the melody phrase represented by the component data file #77 (having a length of two measures). Rectangular strips "k" and "l" show performance sections on the track tr14 covering measures 3-4 and measures 7-8, respectively, which are filled with the melody phrase represented by the component data file #44 (having a length of two measures). Thus disposed rhythm phrases and melody phrases (of performance patterns) are performed together at the respective allocated performance sections along the time progression.

As will be understood from FIG. 2, the performed music piece is a kind of loop-based music. The template data files and the component data files can be prepared, for example, in the following way. As composers compose many music pieces, each having a characteristic structure of a full score as shown in FIG. 2 with the designations of music genre and music tempo, the musical structure and the musical elements are extracted from the composed music pieces, and the extracted elements are arranged to constitute the template data files 1 and the component data files 2 as shown in FIG. 1. The music genre and the music tempo set for each template data file and each component data file are primarily those designated by the composer originally, although they may be altered or modified afterward.

Figure 3:
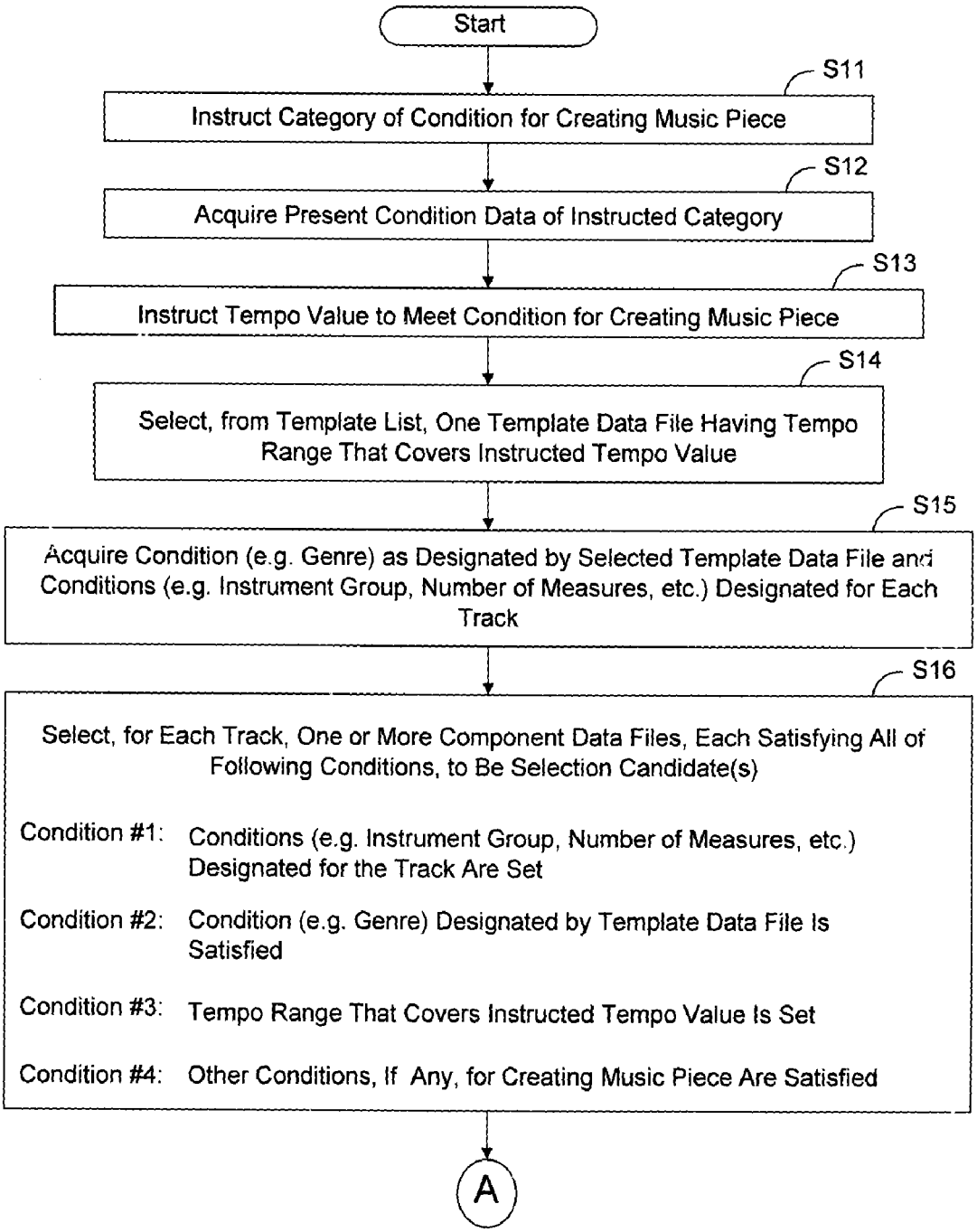
FIG. 3*a* is a chart showing the contents of a template list used in an embodiment of the present invention.
FIG. 3*b* is a chart showing the contents of a template data file used in an embodiment of the present invention.

FIG. 3*a* is a chart showing the contents of a template list used in an embodiment of the present invention. FIG. 3*a* shows only the part of the list contents in the data file, which are necessary for selecting a template data file, omitting the part containing the administration data for making access to the storage regions of the template data files in the data storage. Each template data file constitutes a list with a template ID, a music genre, a music tempo range (slowest tempo and fastest tempo). When a music genre is instructed as the condition for creating a music piece data file, those template data files that have a designation of the instructed genre will be selection candidates. When a music tempo is instructed as the condition for creating a music piece data file, those template data files that have a designation of the tempo value range which covers the instructed tempo value will be selection candidates.

FIG. 3*b* is a chart showing the contents of a template data file used in an embodiment of the present invention. This corresponds to the structure of a music piece to be created as shown in FIG. 2 above. The template data file is a two-dimensional list expressed in rows and columns. For each of the tracks (rows) arrayed in the vertical direction is designated (or assigned) an instrument group to be used to play the musical phrases on the track. With respect to rhythm group instrument, the designation of instrument group may be done simply as "a drum kit." In each of the measures (columns) arrayed in the horizontal direction is put (placed) a flag "11" or "1" or "0" to indicate whether the measure is a performance section on the track by the allotted component data file designated for the assigned instrument group.

In each box of the list, "11" denotes a measure to start playing back the allotted component data file. The performance data of the first measure of the component data file are to be played back and output at this measure with the "11" description. The description "1" denotes a measure to continue playing back the allotted component data file with the performance data of the second measure or thereafter of the component data file. The description "1" will, therefore, be put in where the component data file has a length of two or more measures.

In the case of a component data file consisting of two measures of performance phrase, the data of the second measure of the phrase will be played back and output in the measure having the description "1" following the measure having the description "11" in which the performance of the phrase has started. In the case of a component data file consisting of four measures of performance phrase, the data of the second measure of the phrase will be played back and output in the measure having the description "1" following the measure having the description "11" in which the performance of the phrase has started, and further the data of the third and the fourth measure of the phrase will be played back and output in the third and the fourth measures having the description "1" from the start measure having the description "11," as long as the third and the fourth measure has the description "1."

The description "0" denotes a measure not to play back any performance data. In the case of a component data file consisting of two measures of performance phrase, the data of the second measure of the phrase will be muted (i.e. not be played back), if the measure has the description "0" following the measure having the description "11" in which the performance of the phrase has started. In the case of a component data file consisting of four measures of performance phrase, the data of the second, or the third or the fourth measure of the phrase will be muted, if the measure has the description "0" following the measure having the description "11" or "1."

In addition to the designation of the instrument group, each track may have designations about various effects such as a tone volume (loudness) control, a panning (sound image localization), a reverberation effect, a chorus effect and an expression control. A plurality of tone channels may be assigned to a single track, in which case the designation for the track may include a designation of tone processing channels.

As described above, a template data file may have a designation about the musical genre so that a template data file can be selected according to the designation of the genre and further that a component data file can be selected by the selection key of the genre. As far as genre is concerned, however, the musical performance phrase structure (i.e. an allocation pattern of the performance sections on each track) within a template data file may be different to some extent according to the designated genre, but will not be greatly different according to the genre. The designation by "genre" will reflect greater influence on the component data files to be selected and allotted on the tracks of the template data file. The component data files should therefore be prepared reflecting the differences by the genre of the music to be composed.

FIG. 4*a* is a chart showing the contents of a component list used in an embodiment of the present invention. FIG. 4*a* shows only the part of the list contents in the data file, which are necessary for selecting a component data file, omitting the part containing the administration data for making access to the storage regions of the component data files in the data storage. Each component data file constitutes a list with a component number, an instrument group (Inst. Gr.), music genres, the number of measures, a music tempo range (slowest tempo and fastest tempo) and a priority grade. As to the music genres, a plurality of columns (three columns in the shown example) are provided in the list so that designations of a plurality of music genres can be made per component data file, wherein a flag "1" is set in the column of the genre designated for each component data file identified by the component number. The number of measures indicates the length of the unit performance pattern (phrase) as explained with reference to FIGS. 2 and 3*a*, and is determined to be one or two or three in the embodiment described herein. The priority grade is a value for determining the selection probability of the component data file, i.e. the probability with which the component data file is to be selected from among the component data files that satisfy the conditions for selection. The values of the priority grade are alterable by the user's manipulation.

When an instrument group is specified by the template data file which is selected according to the conditions for creating music piece data file, a component data file or files that have the designation of the specified instrument group (i.e. the specified instrument group is designated in the component data file) will be a selection candidate or candidates. As a music genre is specified by the template data file which is selected according to the conditions for creating music piece data file, a component data file or files that have the designation of the specified genre will be a selection candidate or candidates. When a music tempo or a tempo range is specified by the template data file which is selected according to the conditions for creating music piece data file, a component data file or files that have the designation of the tempo range that covers the specified tempo or tempo range will be a selection candidate or candidates.

FIG. 4*b* is a chart showing examples of instrument groups (a part of available musical instruments are listed) employed in an embodiment of the present invention. Under the column of the "Instrument Group ID," some of the instrument groups are expressed by the names of existing musical instruments. Some are expressed by instrument tone colors. There may be components data files with the designation by an instrument tone color which is not identical to the name of the instrument group. An instrument group is named to cover musical instruments which are often played together in a jam session. Component data files of the same instrument group have similar performance patterns in common rather than instrument tone colors. A component data file having a melody pattern will be prepared in a normalized key (tonality), for example, in the key of C major or A minor In creating a music piece data file using the template data files and the component data files shown in FIG. 1, even if the same template data file is selected, the created music piece data files can be different (sound differently) in accordance with different combinations of the performance patterns (phrases) defined by the component data files selected randomly. If a template data file carries a music piece structure with ten instrument groups, and if there are one hundred component data files available for each instrument group, the number of combinations will make tenth power of hundred of different music pieces. Further, a plurality of template data files increase the number of combinations accordingly. So, many different kinds of music pieces can be created. As the component data file is of a short length (e.g. 1 through 4 measures) of performance pattern (phrase) and is subject to the repeated use thereof, the storage capacity can be extremely small than the case of individually storing the music piece data files of the number of above-mentioned combinations.

Figure 5:
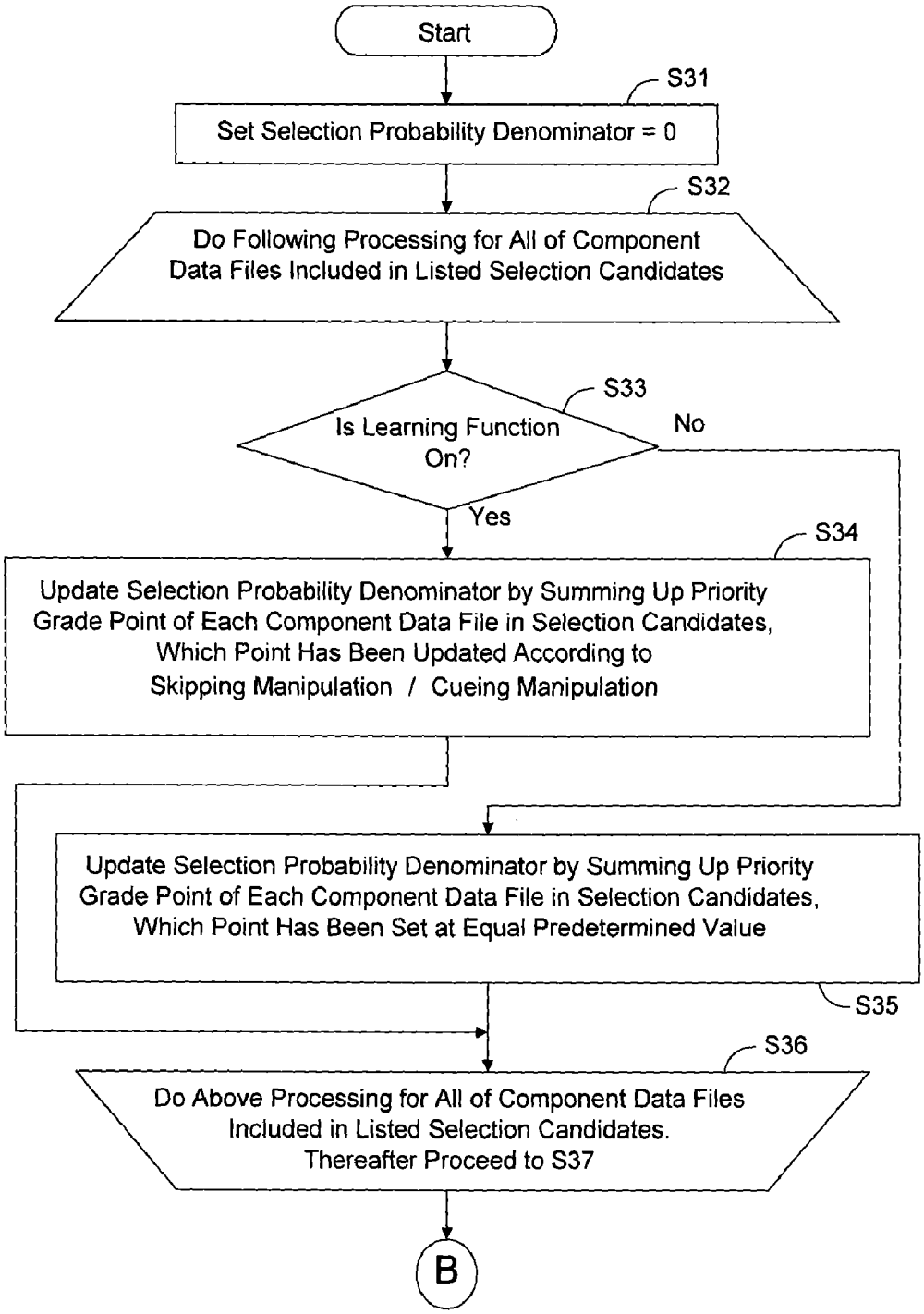
FIGS. 5*a* and 5*b* are, in combination, a flow chart showing the processing for creating a music piece data file in an embodiment according to the present invention.

FIGS. 5*a* and 5*b* show, in combination, a flow chart of the processing for creating a music piece data file based on the music piece creating conditions in an embodiment according to the present invention. The processing flow is conducted with the program executed by the CPU. Steps S11 through S13 are to instruct conditions for creating a music piece data file. The illustrated embodiment is to instruct a musical tempo based on other conditions for creating a music piece data file, and the musical tempo value serves as a primary condition for creating a music piece data file. In order to create a music piece data file having a music tempo which is equal to the user's footstep tempo (movement tempo) at walking or jogging, the movement tempo may be used as the condition for creating a music piece data file. Or the user's heart rate may be used as the condition for creating a music piece data file in order to control the music tempo of the created music piece data file so that the heart rate during an exercise keeps an optimum exercise strength (an intensity percentage to the maximum rate). The step S11 is to instruct the category of the condition for creating a music piece (e.g. the exercise strength). The step S12 is to acquire the present condition data (e.g. the heart rate) of the instructed category. The step S13 is to instruct a tempo value which meets the condition for creating a music piece.

A step S14 selects one template data file having the instructed condition. More specifically, from the template list 3 of FIG. 1, one template data file having a tempo range that covers the instructed tempo value is selected (see also FIG. 3*a*). If there are more than one template data files having a tempo range that covers the instructed tempo value, all of them are selected as selection candidates, and then one will be selected from among the candidates. The final selection of one can be made in any of various ways. For example, the one that has been selected least frequently in the past may be picked up, or one may be randomly picked up from the candidates, or one may be randomly picked up from among those that have never been selected before. Alternatively, the procedure of selecting a component data file, as will be described herein later, in which one is selected according to the selection probability determined by the priority grades of the candidates may be employed in the procedure of selecting a template data file.

Then, for each of the tracks included in the selected template data file, a component date file is to be selected, which is set with conditions that satisfy the instructed conditions for creating a music piece data file and/or the conditions designated in the selected template data file, from among a plurality of component data files that contain instrument groups designated for the track.

More specifically, a step S15 acquires the conditions (e.g. a musical genre) which are designated by the selected template data file and the conditions (e.g. an instrument group, the number of measures) designated for each of the tracks in the selected template data file. Then, a step S16 selects, for each track, one or more component data files, each satisfying all of the following conditions, to bring forth selection candidates.

Condition #1: The conditions (e.g. an instrument group, the number of measures, etc.) designated for the track are set in the component data file.

Condition #2: The conditions (e.g. a musical genre) designated by the template data file is satisfied in the component data file.

Condition #3: A tempo range that covers the instructed tempo value is set in the component data file.

Condition #4: Other conditions, if any, for creating a music piece data file are satisfied.

A step S17 selects, for each of the tracks included in the selected template data file, one component data file according to the selection probability determined by the priority grades of the selection candidates from among the selection candidates of component data files that satisfy the above conditions. A specific procedure this selection will be described in more detail herein later with reference to FIGS. 6*a*, 6*b* and 7. Alternatively, one component data file can be selected from among a plurality of selection candidates by other methods as explained herein above in connection with the selection of a template data file. For example, the one that has been selected least frequently in the past may be picked up, or one may be randomly picked up from the candidates, or one may be randomly picked up from among those that have never been selected before.

With respect to a component data file which is designated in any of the tracks tr1 through thr16 that have pitch data (for melody phrases), a step S18 randomly designates a transposition amount between −12 semitones and +12 semitones for the pitches of the note arrangement pattern, every time the component data file is assigned to the track. In other words, in creating a music piece data file, the transposition amount will be designated randomly first in the processing.

Finally, the performance pattern (note arrangement pattern) of the component data file selected for each of the tracks included in the selected template data file is assigned to the performance sections of the track, thereby composing (assembling) a music piece data file through steps S19 and 20. The step S19 is to create performance data for instructing the tone generator to generate musical tones in the instructed tempo. For each of the tracks in the selected template data file, the step S19 creates performance data for designating tone colors of the performance pattern (phrase) represented by the selected component data file. The step S20 embeds, into the performance sections on each of the track in the selected template data file, performance data (e.g. MIDI format data of note progression patterns) obtained by transposing the performance pattern (phrase) in the component data file allotted to the track, although the rhythm pattern phrases on the rhythm tracks are not subject to transposition. Thus, a music piece data file satisfying the instructed (given) or designated musical conditions is composed automatically. The created music piece data file is stored in a data storage or memory device. Depending on the use of the music piece data file, the music piece data may be temporarily stored in a temporary memory upon creation of every measure of the music piece and may be immediately played back one after another while the next measure of the music piece is being created, like in the case of streaming method.

In the above description, physical conditions (movement tempo, heart rate, etc.) detected by sensors are employed for the conditions for creating a music piece data file, or a music tempo value is directly instructed (given) at the step which needs such a value. But, a music tempo value may be given at the initial step S11. The present invention is applicable also for altering the tempo of the created music piece in response to other elements such as a speed of a car while driving among physical conditions, listening environmental conditions other than musical tempo and musical genres.

As the conditions for creating a music piece data file, conditions other than the musical tempo may be employed. In the embodiment described heretofore, a musical genre can be employed as a condition for creating a music piece data file. If the template data files and the component data files are given other kinds of designations for judging selection conditions for creating music piece data file, in the similar way as the genre designation, the template data file and the component data file which satisfy other kinds of given conditions can be selected.

For example, if the feeling or mood of the user is classified, and some data designations are given, such feeling or mood designation can be put on the template data files or the component data files (either ones may be enough, particularly, the component data files) having a musical characteristic that meets such feeling or mood, in the similar manner that the musical genre is designated. Or, traffic jam conditions, time zones of driving, weather information acquired through communication line and so forth can be obtained as primary conditions for creating music piece data file, from which a feeling or mood can be presumed (calculated), and then the feeling or mood can be used as a condition for selecting a template data file or a component data file. Thus a music piece data file which meets the feeling or mood can be automatically created according to the environmental conditions.

The impressions (e.g. cheerful or gloomy) of the template data files or the component data files may be analyzed and the analyzed impressions may be categorized and/or digitized to set impression parameters as the selection keys for the template data files or the component data files, as in the case of musical genres. In such a case, the feeling or mood is used as a primary condition for creating a music piece data file, and then a musical impression is presumed from the primary condition, and a template data file and/or component data files to which the presumed impression is set will be selected.

Thus, by merely modifying the structure of the template list and/or the component list, the listener's physical conditions, listening environments (e.g. season, time and place) and so forth can be widely and generally used for creating an optimum music piece data file for the user. In addition, a music piece data file will be newly created every time the conditions for creating a music piece data file is given (instructed), which will result in playing back fresh and unboring music pieces. Further, if the selection histories are also stored in the storage device in connection with the template data files or the component data files as mentioned at the steps S15 (FIG. 5*a*) and S17 (FIG. 5*b*), the fact of, for example, the least frequent use or the most frequent use in the past selection history can be the condition for selection in creating a music piece data file.

Figure 6:
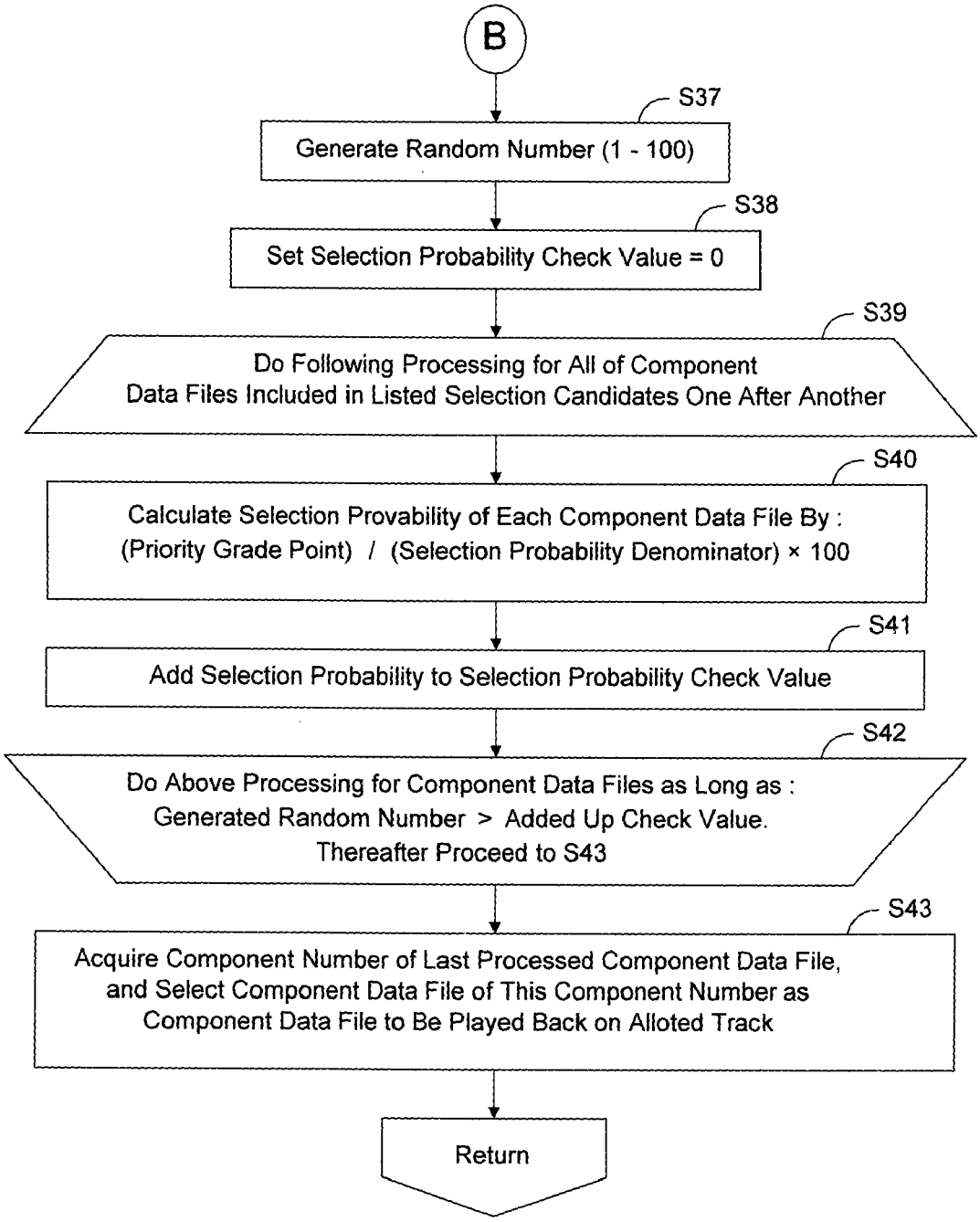
FIGS. 6*a* and 6*b* are, in combination, a flow chart showing in detail the processing for selecting a component data file with a selection probability determined by priority grades as conducted in the step S17 of FIG. 5*b;*

FIGS. 6*a* and 6*b* show, in combination, a flow chart in detail of the processing for selecting a component data file with a selection probability determined by priority grades from among the selection candidates which satisfy the condition for creating a music piece data file, as is conducted in the step S17 of FIG. 5*b*. The processing will be described with respect to one of the tracks, while similar processing will be conducted for the remaining tracks.

Figure 4:
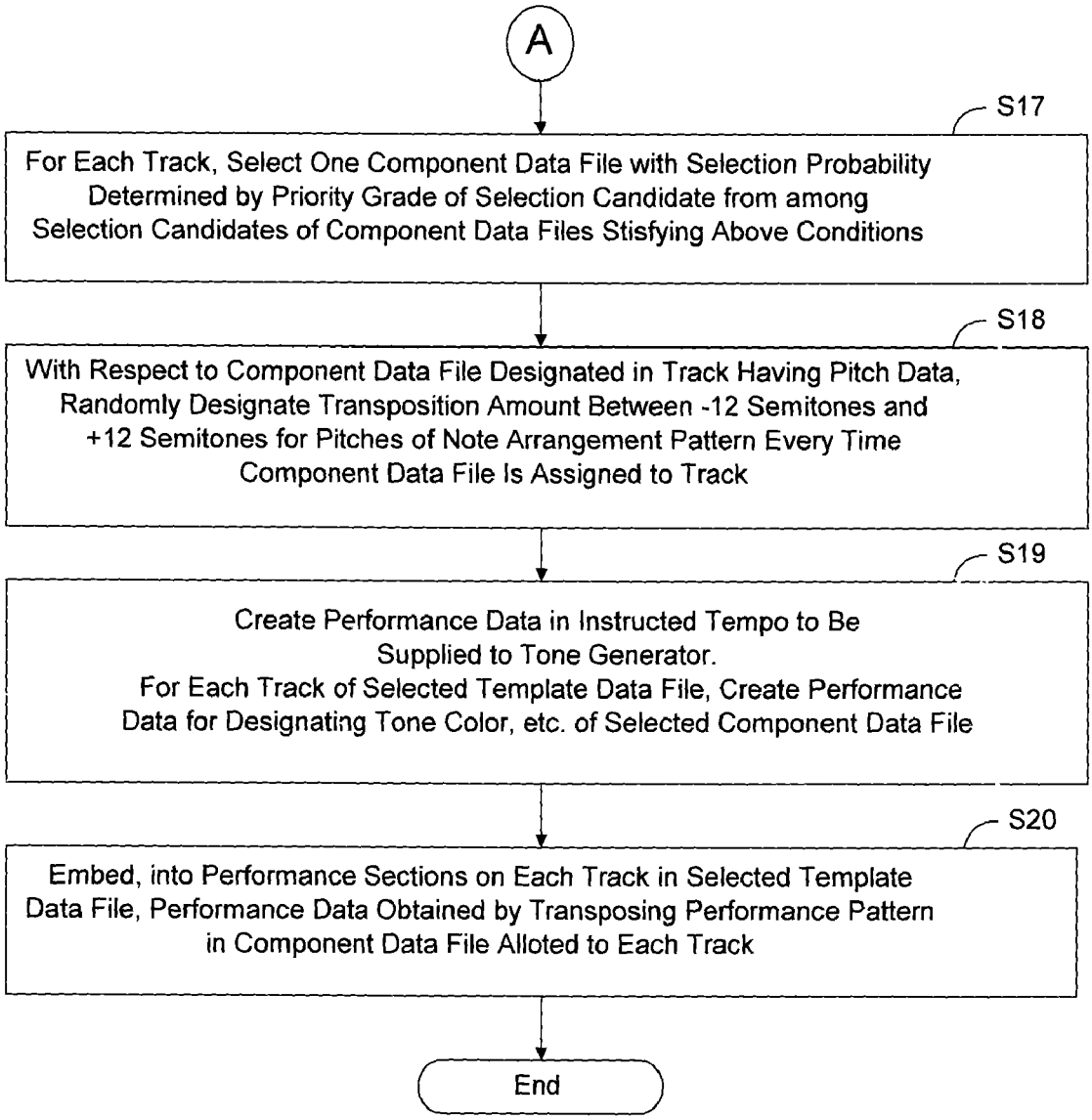
FIG. 4*a* is a chart showing the contents of a component list used in an embodiment of the present invention.
FIG. 4*b* is a chart showing examples of instrument groups employed in an embodiment of the present invention.

FIG. 7 is a chart showing a specific example of how the processing of FIGS. 6*a* and 6*b* is conducted. To begin with, the processing will be explained with reference to FIG. 7. This figure shows the procedure of calculating, in the step S17 of FIG. 5*b*, parameter values to determine a selection probability based on the priority grade points with respect to the selection candidates of component data files having component numbers #24, #18, #35, #79 and #81. As shown in FIG. 4, the component list contains priority grades of the component data files. The priority grades are given to the respective component data files with the initial values when the data are stored in the storage device (e.g. before the shipment from the factory). Typically, the priority grades are set uniformly to the same value (e.g. 10 points) irrespective of the contents of the individual component data files.

In use thereafter, when an automatically created music piece data file is being played back by a music playback apparatus, the user will manipulate the "skip" button to select the next music piece, if the user does not like the music piece being played back. Upon this manipulation, the priority grade point of all the component data files (allotted on the respective tracks) that are included in the automatically created music piece data file which has been being played back will be decreased. Conversely, if the user likes the music piece which is currently being played back, the user will manipulate the "cue" button to listen to the same music from the beginning. The user will also manipulate the "favorites" button to register the music piece he/she likes in the "favorites" group. Upon this manipulation, the priority grade points of all the component data files that are included in the music piece data files which is repeated will be increased.

For example, during the playback of the automatically created music piece data file which includes the component data files #18 and #79 whose priority grade points are "9" and "12," respectively, if the user manipulates the "skip" button, both of the priority grade points are decreased by "−1" (i.e. subtraction of a predetermined value) to make "8" and "11," respectively. On the other hand, when the automatically created music piece data file which includes the component data file #79 whose priority grade point is "12" is being played back, the user's manipulation of the "cue" button to listen to the same music again from the beginning increases the priority grade point by "+1" (i.e. addition of a predetermined value) to make "13."

As a number of automatically created music piece data files are played back, frequent manipulations of the "skip" button or the "cue" button will alter the contents of the component list as shown in FIG. 4*a*, and the music piece data files that greatly reflect the user's liking will be created and played back. The priority grades may be set in association with the physical conditions of the user or the environmental conditions. For example, when the user is listening to the created music piece during exercise, the priority grade may be stored separately for the warmup period, the regular exercise period and the cool-down period.

In the processing for automatically creating music piece data files, the user's physical conditions and the environmental conditions are to be detected first, and then a component data file is to be selected from among the selection candidates using the selection probability value which is calculated from the priority grade points provided for such particular conditions as are detected. Thus, by setting different priority grades to the component data file depending on the environmental conditions, etc., creation of a music piece data file will meet the user's liking which is likely to be influenced by the environmental conditions.

An embodiment of the present invention may be so designed that the priority grade points are to be reset to an initial value in response to the power-on manipulation or the reset manipulation. Or there may be provided a function of arbitrarily setting a priority grade point to each component data file by the user. The priority grade may be determined depending on the time length from the start of the music piece data playback till the skipping manipulation as disclosed in unexamined Japanese patent publication No. 2005-190640 mentioned above in the Background Information. In such a case, the priority grade may be set anew depending on the measured time length by resetting the heretofore set priority grade, or the priority grade may be increased or decreased by accumulating an increment or decrement determined by the measured time length till the skipping manipulation.

Now turning back to FIGS. 6*a* and 6*b*, the processing for selecting a component data file using a selection probability which is determined by the priority grades will be described. In the flow chart of FIGS. 6*a* and 6*b*, a step S31 (FIG. 6*a*) sets the initial value of the selection probability denominator to be equal to "0." The selection probability denominator, herein, is a numerical value which is used as a denominator for defining a selection probability. Steps S32 through S36 are to obtain a selection probability denominator by accumulating the priority grade points of all the component data files included in the list of the selection candidates. The step S33 judges whether the function of learning the user's liking over music pieces is set "on." If the judgment is affirmative, "Yes," the process flow proceeds to the step S34, which updates the selection probability denominator by summing up the priority grade point of each component data file listed in the selection candidates as shown in FIG. 7. The priority grade points of the component data files may have been updated according to the "skip" manipulations or the "cue" manipulations according to the design of the system as mentioned above.

When the judgment at the step S33 is negative, "No," the process flow goes forward to the step S35, which sets the priority grade of all the component data files included in the list of the selection candidates at an equal value (e.g. "10"), not changing the priority grade in the component list of FIG. 4*a*, and updates the selection probability denominator by summing up the priority grade point of the equal value of the component data files listed in the selection candidates during the repeated process from the step S32 through the step S36. The step S35 is to make the same process by steps S37 through S42 (FIG. 6*b*) for random selection applicable to both of the judged situations. As an alternative, the step of judging whether the learning function is "off" can be placed before the step S32 and a step of setting the selection probability (in %) of all the component data files included in the list of selection candidates to be 100/(the number of the component data files in the list) can be provided in place of the steps S32 through S36.

The steps S37 through S43 are to select a component data file according to the selection probability that reflects the user's liking. The selection probability of each component data file is determined by using the value of priority grade which has already been updated according to the number of manipulations of the "skip" or "cue" button performed during the playback of the automatically created music piece data file. The step S37 generates one random number. The random numbers are numbers (values) distributed uniformly with equal probability of occurrence. In the illustrated example, values between "1" and "100" are generated randomly. The step S38 sets the initial value of a selection probability check value to be "0." The selection probability check value is a work value to be compared with the random number generated at the step S37, and is given to each component data file in the following repeated process loops.

Steps S39 through S42 are to randomly select or pick out one component data file from among the selection candidates of component data files. The step S39 starts the repeated processing loops to conduct for all the component data files included in the list of the selection candidates one after another until the step S42 stops the repetition. The step S40 calculates a selection probability of each component data file by the following equation:

$$\text{"Selection Probability"(in \%)} = (\text{Priority Grade Point})/(\text{Selection Probability Denominator}) \times 100.$$

Then the step S41 adds the value of the selection probability calculated in the step S40 to the selection probability check value. The step S42 directs the process flow back to the step S39 as long as the random number value generated at the step S37 is greater than the selection probability check value obtained in the step S41, but if the added-up probability check value becomes equal to or greater than the random number value, the process flow is directed forward to a step S43. The step S43 acquires the component data file number (component #) of the last processed component data file in the step S41, and selects the component data file of this acquired component number from among the selection candidates.

FIG. 7 shows an example of the processing which would take place if the judgment condition in the step S42 should not be placed, for better understanding the procedure. The processing is described with items (in columns) of the selection candidate, the priority grade point, the number of the process loop, the selection probability and the selection probability check value. As the processing of FIG. 7 starts with the first component data file in the selection candidates and goes forward, the first loop (loop 1) handles the component data file of #24 to calculate the selection probability "20" by 10/50 and the selection probability check value "20" by 0+20. The second loop, the third loop and the fourth loop conducts the processing similarly, until the fifth loop (loop 5) handles the component data file of #81 to calculate the selection probability "18" by 9/50 and the selection probability check value "100" by 82+18.

In the actual specific procedure, for example, where the step S37 generates a random number value "5," the first process loop handles the component data file #24 and the step S42 judges that the check value "20" is greater than the random number value "5" and the step S42 directs the process flow forward to the step 43, which acquires the component data file number "#24." In the case where the step S37 generates a random number value of "70," the process loop proceeds up to the fourth loop, in which the step S42 judges that the check value "82" is greater than the random number value "70" and the step S42 directs the process flow forward to the step 43, which acquires the component data file number "#79."

While the step S37 generates random number values between "1" and "100" uniformly, the value interval between the adjacent check values is equal to the selection probability value of the latter component data file of the adjacent two. This means a component data file having a greater selection probability value has a proportionally greater chance (i.e. probability) of being selected. Thus the component data files which are included in the automatically created music piece data file against which the user manipulates the "skip" button more frequently will be selected less frequently for creating a music piece data file afterward. On the contrary, the component data files which are included in the automatically created music piece data file against which the user manipulates the "cue" button more frequently will be selected more frequently for creating a music piece data file afterward.

To summarize, the priority grade of the component data file (one component data file is allotted per track) included in the automatically created music piece data file is determined in accordance with the user's manipulations during the playback of the automatically created music piece data file. The higher the priority grade of the component data file is, the higher the probability is of being selected from among the selection candidates which satisfy the same condition for creating a music piece data file. The apparatus for automatically creating a music piece data file according to the present invention will automatically create music piece data files which will closely fit for the user and play back the same. When the automatically created music piece does not meet the user's feeling at the time it is being played back, the user can easily switch to another one, and the apparatus learns the likes and dislikes of the user, which will be reflected in the future operations of the apparatus in automatically creating music piece data files.

FIG. 8 is a block diagram showing the functional configuration of an embodiment of a music playback controlling apparatus to be used in combination with the apparatus for automatically creating a music piece data file as described above. A block 51 is to acquire music performance data files in the data format of tone waveform, and a block 52 is to store the acquired performance data files. Together with the performance data files, the original tempo values of the respective music performances are also stored in the data storage 52. If the performance data file is subject to a compression/expansion processing along its time axis, the musical tempo of the played-back music will be changed accordingly. The term "original temp" denotes the tempo of a live musical performance which is recorded in the shape of waveform data and is not time-compressed or time-expanded. If the acquired music performance data file does not include a tempo value, a tempo value can be obtained by extracting the original musical tempo by automatically analyzing the acquired music performance data file. A plurality of template data files and a plurality of component data files to be used for the automatic creation of music piece data files can be installed beforehand in a flash ROM at the shipment from the factory. Alternatively, data files of an upgraded version may be acquired by the music performance data acquiring device 51.

The data storage 52 stores music performance data files in waveform data format, and the template data files 1, the component data files 2, the template list 3 and the component list 4 as shown in FIG. 1, as well. The data storage 52 further stores data files used for music piece selection processing, such as data representing the number of playbacks of the performance data files and the priority grade points. An automatic created music piece data file (in the data format of SMF or data format specific to a used sequencer) may be stored in the data storage 52 temporarily and may be erased after the playback is finished.

A block 59 is to detect various manipulations by the user and the detected manipulations are outputted for a block 53. The block 53 is to set various parameters for controlling a condition instructing device 56 and a playback controlling device 57, and the parameters are stored in a memory included in the parameter setting device 53 or in the data storage device 52. The parameters include, for example, the current operating mode of the apparatus, personal data (including physical data) of the user, an initial musical tempo and a target exercise strength. A block 54 is to detect the tempo of a repeated movement such as at the time the user is walking or jogging, which is used in the "free mode" operation of the apparatus. A block 55 is to detect the heart rate of the user such as at the time the user is walking or jogging, which is used in the "assist mode" operation of the apparatus.

A block 56 is to instruct (generate and provide) conditions such as a musical tempo value to be supplied to the playback controlling device 57. The condition instructing device 56 also instructs other conditions (than the musical tempo) for automatically creating music piece data files. The condition instructing device 56 also receives data of the current playback position, the musical tempo, etc. of the music piece data file which is currently being played back from the data storage 52.

The playback controlling device 57 has similar music playback controlling functions as in the conventional music data playback device such as the MP3 player, and also a function of selecting a music piece data file that satisfies the conditions such as the musical tempo instructed by the condition instructing device 56 from among the music piece data files stored in the data storage 52 and causing the music piece data file playback device 58 to play back the selected music piece data file. Or, the playback controlling device 57 causes the music piece data file creating apparatus 60 (the one described above) to automatically create a music piece data file in the data format of musical notation (note-and-time description). When the music piece data file selected by the playback controlling device 57 is a music piece data file in the data format of tone waveform, the music piece data file playback device 58 plays back the selected music piece data file in its original musical tempo, and when the selected music data file is in the data format of musical notation (received from the block 60), the playback device 58 plays back the selected music piece data file in the tempo instructed by the condition instructing device 56. The played-back audio signals are outputted for a loudspeaker or a headphone.

In a music listening mode of operation, the playback controlling device 57 selects an arbitrary music piece data file from among the music piece data files (in the data format of tone waveform or the data format of musical notation) stored in the data storage 52, and starts, pauses and stops playing back the selected music piece data file.

In a free mode of operation, the condition instructing device 56 instructs a musical tempo which is determined from the tempo of a repeated movement which is detected by the repeated movement tempo detecting device 54. The playback controlling device 57 selects, from among a plurality of music piece data files stored in the data storage 52, a music piece data file that has a musical tempo value substantially equal to the tempo value instructed by the condition instructing device 56, or more specifically, a music piece data file that has a musical tempo value which is within a predetermined tolerable range from the instructed musical tempo from the condition instructing device 56, and causes the music piece data file playback device 58 to play back the selected music piece data file.

In an assist mode of operation, the condition instructing device 56 instructs (generates and provides) a musical tempo value by setting an initial value at the original musical tempo set by the parameter setting device 53 and then adjusting the value so that the difference between the actual heart rate (in beats per minute) (i.e. the actual exercise strength) detected by a heart rate detecting device 55 and the target heart rate (in bpm) which corresponds to the target exercise strength set by the parameter setting device 53 becomes smaller.

In the described embodiment with the combination of an automatic music piece data file creating apparatus and a music playback controlling apparatus, a music piece data file in the data format of tone waveform is played back with higher priority, and in case there is no such data file having the musical tempo value instructed by the condition instructing device 56, a music data file in the data format of musical notation which is automatically created in the instructed musical tempo will be played back.

The music piece data file creating device 60 conducts the processing described in FIGS. 5*a* and 5*b*, and accordingly comprises a music piece data creating condition instructing device for instructing a musical tempo, a template selecting device for selecting a template data file (the tempo range and the musical genre are set) which satisfies the instructed musical tempo, a component selecting device for selecting, for each of the tracks included in the selected template data file, a component data file having designated conditions which satisfy the musical tempo instructed by the music piece data creating condition instructing device and the musical genre designated in the selected template data file from among a plurality of component data files which are for the instrument groups designated in the selected template data file, and a music piece composing device for composing a music piece data file by allotting musical phrase data pieces of the component data file selected for each track at the performance sections located on each track in the selected template data file, designating the instructed musical tempo.

Upon instruction of a musical tempo from the condition instructing device 56, the playback controlling device 57 selects, if any, a music piece data file in the data format of tone waveform having the designated musical tempo that is substantially equal to the instructed musical tempo from among the music piece data files in the format of tone waveform which are stored in the data storage 52, and if not, conveys the musical tempo instructed from the condition instructing device 56 to the condition instructing device in the music piece data file creating device 60 to create a music piece data file of the instructed musical tempo, causes the data storage 52 to store the thus created music piece data file and selects the thus created and stored music piece data file, so that the music piece data file playback device 58 plays back the selected music piece data file.

FIG. 9 is a block diagram showing the hardware configuration for creating a music piece data file in an embodiment of the present invention. Shown is an embodiment in the form of a portable music playback apparatus comprising an acceleration sensor. The apparatus is to be worn by the user around the waist or on the arm with a heart rate detector for the earlobe installed on the headphone. The apparatus comprises a central processing unit (CPU) 71, a flash read only memory (ROM) 72 or a small-sized mass storage magnetic hard disk, and a random access memory (RAM) 73.

The CPU 71 performs the constituent functions of the present invention by executing firmware control programs stored in the ROM 72. The RAM 73 is used as a temporary storage area necessary for conducting the processing by the CPU 71. The flash ROM 72 is also used as the data storage 52 of FIG. 8. When the CPU 71 selects a music piece data file from among the music piece data files stored in the flash ROM 72, it stores the selected music piece data file temporarily in the RAM 73. Also when a music piece data file is automatically created, the CPU 71 stores the created music piece data file temporarily in the RAM 73. When a music piece data file is played back, the CPU 71 transfers the music piece data file (in the data format of tone waveform or of musical notation) stored in the RAM 73 to a music data playback circuit 80.

Controls 74 include a power on/off switch, push button switches for various selections and settings, and so forth. A display device 75 is a liquid crystal display (LCD) panel for displaying the contents of input manipulations for setting, the conditions of the music piece data file playback, the results after an exercise, etc. The display device 75 may include light emitting diodes (LEDs) for lighting or blinking indications. The setting manipulations are preferably be done in a menu selection manner. The controls 74 may include a menu button and selection buttons, wherein every manipulation of the menu button sequentially changes the menu items displayed on the display device 75 and manipulation of a selection button or buttons (simultaneous) can select the content to be set, and the manipulation of the menu button after the selection will fix the selection.

A repeated movement tempo sensor 76 may be a bi-axial or tri-axial acceleration sensor or a vibration sensor, which are installed in the main body of the music playback apparatus for exercising use. A heart rate detector 77 is a pulse sensor to detect the heart rate of the wearer. A clock 78 includes a master clock (MCLK) which provides timing clock pulse for the CPU 71 to execute the various processing, and a real time clock (LTC) which keeps on running to tell the date and time even during the power-off condition. A power source 79 may be an installed battery cell or may be an AC adapter. Or the power may be supplied from an external apparatus via a USB terminal.

A music data playback circuit 80 receives, from the RAM 73, a music piece data file which is selected and designated by the CPU 71 for playback, converts the data file to analog signals, amplifies and outputs the analog signals for the headphone, earphone or loudspeakers (81). The music data playback circuit 80 receives a digital waveform signal and plays back an analog waveform signal. In case the inputted data signal is a compressed waveform, the signal is first decompressed and then converted to an analog signal. The music data playback circuit 80 is equipped with a MIDI synthesizer function to receive a music piece data file in the data format of musical notation and synthesize tone signals to play back the analog waveform data signals. The music data playback circuit may be realized by separate hardware blocks depending on the data format of the input data signal. Or part of the processing may be performed by the CPU 71 running a software program.

A server apparatus 83 comprises a database storing a multiplicity of music piece data files. A personal computer (PC) 82 makes an access to the server apparatus 83 via a communication network so that the user can select a desired music piece and download the selected one to the storage device of the user's own.

The personal computer (PC) 82 may analyze music piece data files stored in its own hard disk (HD) or music piece data files picked out from a compact disc (CD) or other storage media, and may acquire music piece administration data such as a musical tempo, a musical tonality (key) and musical characteristic parameters together with the music piece data file.

When the CPU 71 acquires a music piece data file, it sends out the music piece administration data from the personal computer 82 via the USB terminal to the flash ROM 72 to store therein. Where the server apparatus 83 is provided with updating firmware, the firmware stored in the flash ROM 72 can be updated via the personal computer. A plurality of music piece data files accompanied by music piece administration data, and a plurality of template data files and a plurality of component data files to be used for automatically creating a music piece data file stored in the flash ROM 72 may be stored as preset data files at the shipment of the apparatus from the factory.

The apparatus of the present invention can be realized in the form of a cell phone terminal or a personal digital assistant (PDA). The apparatus of the present invention can also be realized in the form of a floor type equipment to be used for indoor training, for example, for a running exercise on a treadmill. While both of the specific examples described above are music piece playback apparatuses, at least one of the function of playing back the music piece data files, storing the data and storing the music piece data files can be realized by an external device and the present invention can be realized in the form of an apparatus which has a function of controlling the music piece data file playback function only. More specifically, the functions of playing back music piece data files, storing music piece data files, and acquiring music piece data files are realized by a conventional music data playback apparatus such as an MP3 player, and a music data playback controlling interface is provided in such a conventional music data playback apparatus, and an apparatus having only a function of music data playback controlling function is externally connected to the conventional music data playback apparatus via the music data playback controlling interface.

In the hardware configuration of FIG. 9, the flash ROM 72 is employed as the data storage 52 of FIG. 8, but a storage device in the personal computer 82 can be used instead as the data storage 52 of FIG. 8 to construct a music piece data file playback system, or the apparatus of the present invention may be connected directly to the server apparatus 83 via a communication network and not via a personal computer 82 to constitute a music piece data file playback system including the communication network therein using the database in the server apparatus 83 as the data storage 52 of FIG. 8.

In the above description, walking, jogging and running are mentioned as examples of repeated movement. The present invention can be applied in the case of listening to music while doing an exercise of repeated movement, for example, an exercise using a training machine such as a bicycle type ergometer, a treadmill and a strength machine, gymnastics and dancing. According to the kind of repeated movement, the acceleration sensor can be put on an appropriate position of the human body, an acceleration characteristic can be determined to judge one step of repeated movement, and an appropriate algorithm to detect this one step of repetition can be designed. In such a case, in the free mode of operation, a repetition movement tempo (repetition frequency per unit time) which can be determined by one-step time period of repetition as a unit movement of the repeated movement will be detected, in place of the walking pitch. In the assist mode of operation, the initial value of a repeated movement tempo is set, in place of the initial value of the walking pitch. A target exercise strength (target heart rate) is set similarly.

While several preferred embodiments have been described and illustrated in detail herein above with reference to the drawings, it should be understood that the illustrated embodiments are just for preferable examples and that the present invention can be practiced with various modifications without departing from the spirit of the present invention.

This application is based on, and claims priority to, Japanese Patent Application No. 2007-081857, filed on Mar. 27, 2007. The disclosure of the priority application, in its entirety, including the drawings, claims, and the specification thereof, is incorporated herein by reference.

What is claimed is:

1. An apparatus for automatically creating music piece data comprising:

a memory device for storing a plurality of component data files, each having a priority grade for being selected and each representing a length of musical phrase that constitutes a predetermined tone progression pattern of a predetermined tone color for a performance by a particular instrument group, and a plurality of template data files, each designating a structure and conditions of a music piece and including a plurality of tracks, each track being assigned to a particular instrument group and defining a time progression structure of music to be performed by the assigned instrument group by setting performance sections at time positions to be performed by the assigned instrument group along the time progression of music;

a condition instructing device for instructing conditions for creating a music piece data file;

a template selecting device for selecting a template data file that satisfies the conditions instructed by the condition instructing device;

a component selecting device for selecting, for each of the plurality of tracks included in the template data file that is selected by the template selecting device, candidate component data files, each of which satisfies at least one of the conditions instructed by the condition instructing device and the condition designated by the template data file that is selected by the template selecting device, from among the plurality of component data files which are for the instrument group assigned to the track, and then selecting a component data file from among the candidate component data files according to a selection probability that is calculated based on the priority grade of each candidate component data file; and a music piece composing device for composing a music piece data file by disposing the musical phrases of the component data files selected by the component selecting device at the performance sections set on the tracks in the template data file that is selected by the template selecting device.

2. An apparatus as claimed in claim 1, wherein the template data file includes designations of a musical tempo and a musical genre of music to be created;

the component data file includes designations of a musical tempo and a musical genre of music for which the musical phrase is to be used;

the condition instructing device instructs at least a musical tempo of music to be created;

the template selecting device selects a template data file that satisfies at least the musical tempo instructed by the condition instructing device;

the component selecting device selects, for each of the plurality of tracks included in the template data file selected by the template selecting device, a component data file that includes a designation of a musical tempo of substantially the same value as the tempo value instructed by the condition instructing device and a designation of a musical genre included in the template data file selected by the template selecting device, from among the plurality of component data files which are for the instrument group designated for the track; and the music piece composing device composes a music piece data file by designating the musical tempo that is instructed by the condition instructing device.

3. An apparatus as claimed in claim 2, wherein the condition instructing device instructs the musical tempo based on a physical condition of a user of the apparatus.

4. An apparatus as claimed in claim 3, wherein the physical condition of the user is a movement tempo or a heart rate of the user.

5. An apparatus as claimed in claim 1, further comprising:

a music piece playback device for playing back the music piece data file composed by the music piece composing device;

a manipulation detecting device for detecting a manipulation by a user of the apparatus to alter the priority grade; and a priority altering device for altering the priority grade of at least one of the component data files comprised in the music piece data file which is being played back in response to the detected manipulation to alter the priority grade during the playback of the composed music piece data file by the music piece playback device.

6. A music playback controlling apparatus to be used in combination with the apparatus as claimed claim 2 wherein the composed music piece data file is in a data format of musical notation, the controlling apparatus comprising:

a music waveform data storing device for storing a plurality of music piece data files representing music pieces in a data format of tone waveform, each of the stored music piece data files having a designated musical tempo at which the stored music piece is to be played back;

a musical tempo instructing device for instructing a musical tempo of a music piece to be played back;

a music piece selecting device for selecting, if any, a music piece data file in the data format of tone waveform having the designated musical tempo that is substantially equal to the musical tempo instructed by the musical tempo instructing device from among the music piece data files in the data format of tone waveform, and if not, causing the condition instructing device to instruct the musical tempo that is instructed by the musical tempo instructing device, thereby causing the music piece composing device to compose a music piece data file at the instructed musical tempo, and selecting the thus composed music piece data file; and a music piece playback device for playing back the music piece data file selected by the music piece selecting device.

7. A method for automatically creating music piece data comprising:

a step of storing a plurality of component data files, each having a priority grade for being selected and each representing a length of musical phrase that constitutes a predetermined tone progression pattern of a predetermined tone color for a performance by a particular instrument group, and a plurality of template data files, each designating a structure and conditions of a music piece and including a plurality of tracks, each track being assigned to a particular instrument group and defining a time progression structure of music to be performed by the assigned instrument group by setting performance sections at time positions to be performed by the assigned instrument group along the time progression of music;

a step of instructing conditions for creating a music piece data file;

a step of selecting a template data file that satisfies the conditions instructed by the step of instructing;

a step of selecting, for each of the plurality of tracks included in the template data file that is selected by the step of selecting a template data file, candidate component data files, each of which satisfies at least one of the conditions instructed by the step of instructing and the condition designated by the template data file that is selected by the step of selecting a template data file, from among the plurality of component data files which are for the instrument group assigned to the track, and then selecting a component data file from among the candidate component data files according to a selection probability that is calculated based on the priority grade of each candidate component data file; and a step of composing a music piece data file by disposing the musical phrases of the component data files selected by the step of selecting a component data file, at the performance sections set on the tracks in the template data file that is selected by the step of selecting a template data file.

8. An apparatus as claimed in claim 1, wherein the template data file selected by the template selecting device carries flags to indicate, with respect to each track and the time progression structure of music, whether the component data file selected by the component selecting device is to be played back or not.

* * * * *